US005630243A

United States Patent [19]

Federico et al.

[11] Patent Number: 5,630,243

[45] Date of Patent: May 20, 1997

[54] TOILET CLEANING DEVICE WITH CLEANING PAD

[76] Inventors: Vera L. Federico; William F. Gabella, both of 1941 Summit Dr., Escondido, Calif. 92027

[21] Appl. No.: 558,644

[22] Filed: Feb. 14, 1996

[51] Int. Cl.[6] ..... B08B 1/00

[52] U.S. Cl. ..... 15/104.94; 15/210.1; 15/231; 294/19.1

[58] Field of Search ..... 15/104.93, 104.94, 15/210.1, 231, 233; 294/19.1

[56] References Cited

U.S. PATENT DOCUMENTS

| | | | |
|---|---|---|---|
| 2,666,224 | 1/1954 | Adams | 15/231 |
| 3,383,158 | 5/1968 | Leland | 15/210.1 |
| 4,031,673 | 6/1977 | Hagleberg | 15/210.1 |
| 4,160,563 | 7/1979 | Whitney | 294/19.1 |
| 4,260,186 | 4/1981 | Sky-Eagle | 294/19.1 |
| 5,154,465 | 10/1992 | Pakosh | 294/19.1 |

FOREIGN PATENT DOCUMENTS

| | | | |
|---|---|---|---|
| 2472787 | 7/1981 | France | 294/19.1 |
| WO87/00022 | 1/1987 | WIPO | 15/210.1 |

*Primary Examiner*—David Scherbel
*Assistant Examiner*—Terrence Till

[57] ABSTRACT

A plastic tool with a handle and trigger at one end and a pair of jaws (one of which is moveable) at the other end which are inserted into a biodegradable paper cleaning pad filled with cleaning/disinfectant and/or deodorant materials. The lower jaw of the tool is moveable by way of a trigger near the handle. When depressed the trigger compresses a lock spring and moves an actuator rod down the barrel which operates a hinge to open the jars far enough to be inserted into the cleaning pad. The open jaws surround a paper tab which forms the center of the double-walled cleaning envelope. On the release of the trigger the coil operating spring decompresses and moves the actuator rod back toward the handle locking the jaws over the center tab of the cleaning pad. Facilitated by a nominal 15-degree bend in the barrel of the cleaning tool and the flexible tip of the cleaning pad, the cleaning tool can reach all surfaces within the toilet to clean the unit. The soiled and used cleaning pad is disposed of by pointing the tools toward the toilet bowl and again squeezing the trigger, which causes the jaws to open and permits the used cleaning pad to drop into the toilet bowl to be flushed away.

4 Claims, 10 Drawing Sheets

TOILET CLEANING DEVICE WITH CLEANING PAD

BACKGROUND—FIELD OF INVENTION

This invention relates to an improved method and means of cleaning and disinfecting toilets, urinals, bidets, and similar bathroom facilities.

BACKGROUND—DESCRIPTION OF PRIOR ART

An absolute necessity in every area of modern life is the need for an efficient and easy means of cleaning, disinfecting, and even deodorizing toilets, both flushing and non-flushing types, as well as urinals, bidets and similar bathroom fixtures.

Many inventors have tried to address parts of this problem by means of some sort of toilet cleaning tool which grasps a cleaning pad and disposes of the used, soiled pad without a person being required to remove it by hand from the end of the tool. Analysis of the prior art reveals a number of shortcomings in each design and proposed application.

U.S. Pat. No. 2,786,223, Ziskind (Sconring Pad Holder) has as its primary purpose the holding of scouring pads for pots and pans and the like. It is a fairly complex mechanism with a short handle—too short to allow for the cleaning of toilets without the operator's hand coming either in contact with dirty toilet surfaces or the operator being placed too close to the spray of harmful or dangerous bacterial or viral organisms.

U.S. Pat. No. 3,131,409, Davis (Hot Grill Cleaning Device), is primarily intended to clean hot metal grills with metal cleaning pads.

U.S. Pat. No. 3,753,267, Johnson Sr., (Bathtub Cleaning Mop), is a long-handled cleaning mop for use on bathtubs and the like. The device features a means of engaging and disposing of sponge mops and the like. It has major shortcomings for use on toilets—the mop engaging device requires squeezing a spring at the "dirty end" of the mop to acquire or dispose of the mop pad; and, the long handle would limit its access to all parts of the toilet and toilet bowl since the handle is long straight and not angular. The manner of sanitizing a toilet is not addressed.

U.S. Pat. No. 2,572,178, Monroe and McClement, (Cleaning Device of Swab or Mop Type), intended for the use of cleaning toilets is deficient in several respects. First, the inventors do not describe how the flimsy paper mop or swab can be attached or removed from the dirty end of the device without being physically handled by the operator. There is no mention of some receptacle or like device to keep the flimsy mops or swabs in an upright and stable position to facilitate being grasped by the device. Second, the long, straight handle of the device would limit access of the swab to all parts of the toilet, as similarly noted in the Johnson, Sr., patent in the paragraph above. Sanitizing the toilet is not addressed.

U.S. Pat. No. 2,648,085, Rodgers (Cleaning Swab for Toilet Bowls), is intended for use in cleaning toilets. There are two discrepancies with this patent. First, the familiar objection—the long straight handle which limits access to the toilet. Second, the means of ejecting the used swab is not positive but relies on the operator twirling the limp swab up against the edge of the toilet in an effort to release it from the internal spring in the handle it appears the stud portion of the swab may remain inside the barrel of the device while the wet and disintegrating swab is broken-off. This would require the operator to "dig-out" the broken portion of the swab by hand or tool—negating the sanitary aspects of the device's intended purpose. Also, the issue of disinfecting the toilet is not addressed.

U.S. Pat. No. 4,031,673, Hagelberg, (Cleaning Device for Water Clostes), this device intended to clean toilets is deficient in several respects first, is the long, straight handle, whose objection is cited above. Secondly, it presents only one cleaning surface to the object being cleaned. Third, and most important is the fact the stick often no positive locking mechanism for the pad, relying on friction only between the piston and the barrel of the handle. This is insufficient to create a positive lock, especially when cleaning motion may cause the outer barrel to slip causing the inner piston to release its grasp on the cleaning pad. Finally, the patent does not offer disinfecting the toilet.

Our invention is vastly superior to those cited above on a number of grounds. First, the portion of the tool which enters the toilet bowl is angled a nominal 15-degrees from the centerline of the tool shaft to permit the operator to reach under the rim of toilet bowls for thorough efficient cleaning. This frees the operator from straining to reach these important areas—a major advantage considering the number of citizens who have limited hand and wrist motion from illnesses (rheumatoid arthritis, etc.) or injuries.

Secondly, our tool offers an easy-to-grip, handle which makes it easier and more comfortable for persons, whatever age or physical condition, to grasp and operate the tool, either singlehandedly or with both hands. This action is complemented by the use of a trigger-type release to open the jaws of the tool to either grasp or release the biodegradable cleaning envelope which fits over the clamping jaws of the tool.

Third, the trigger-type release is a comfortable, reliable, easy-to-operate mechanism whether the operator uses one hand or both. The jaws of the tool are normally spring-loaded closed. When the trigger mechanism is squeezed the jaws of the tool far enough to grasp the anchor tongue in the center of the cleaning envelope. By releasing the trigger, the spring mechanism locks the jaws of the tool shut. The "OPEN" and "CLOSE" commands are communicated to the jaws by means of a rod attached to the upper lobe of the trigger.

Fourth, the simple, double-walled biodegradeable envelope differs and improves upon other cleaning pads cited above since the cleaning compounds contained within the pads can be customized to suit differing customer needs, e.g., for hospitals and contagious wards within hospitals, for scientific laboratories (especially those handling viruses and potent toxic bacterias); and, for general home and residential use. E.G., a typical disinfectant mixture for a hospital ward toilets could consist of a dry detergent for cleaning and calcium hypochlorite as a disinfectant.

Fifth, in addition to customizing cleaning and disinfecting agents in the cleaning pad, deodorants can also be added to the cleaning pad so that the separate tasks of cleaning, disinfecting, and deodorizing can be done with one cleaning pad.

Seventh, a unique feature of the cleaning pad is that it is made about 33-percent longer than the jaws of the cleaning tool so that approximately one-third of the length of the cleaning pad center section has cleaning powder inside. Thus when the cleaning pad is moistened in the toilet bowl, the pad can curve and conform to the curved walls of the toilet bowl. This feature plus the 15-degree curve of the cleaning stick barrel ensures the entire interior surface of the bowl, even the areas under the rim, comes in contact with the cleaning pad.

Finally, one of the problems inherent with a toilet cleaning device is where to store it between uses. Our solution is to provide for a storage container which consists of a free-standing (it can also be used as a wail-unit) plastic box organized to hold box(es) of cleaning pads and the cleaning tool. The cleaning pads are arranged in vertical shelving for easy and immediate access. A niche is provided in the box for the storage of the cleaning tool.

Objects and Advantages

Accordingly, besides the objects and advantages of the toilet cleaning tool described in our patent, several objects and advantages of the present invention are:

(a) to provide a safe and efficient means of cleaning and disinfecting all parts of a toilet without the necessity of ever touching the cleaning end of the tool;

(b) to provide a disposable cleaning and/or disinfectant pad for the cleaning tool that can easily be acquired and disposed by the tool;

(c) to provide a method whereby a toilet cleaning tool may be stored between uses in a clean and sanitary condition;

(d) to provide a method whereby an easily accessed removeable, receptacle is provided for the storage and acquisition of the cleaning pads;

(e) to provide a total "cleaning system," as it were, by providing a plastic box that contains the cleaning pads ready for dispensing, the toilet tool, and the plastic box itself, which can used as a freestanding box in a bathroom and/or capable of being affixed to a wall or closet or bathroom cabinet door;

(f) to provide a means of "customizing" the type of cleaning by offering the ability to offer compounding of several different cleaning agents, deodorants, and disinfectants appropriate to customers' use in the disposable cleaning pads, e.g., ranging from strong disinfectant/detergent mixes for deadly viruses to simple detergent cleaning applications plus the addition of deodorant.

DESCRIPTION OF THE DRAWINGS

Both isometric and orthographic projections are used to explain the simple workings of the toilet cleaning tool and the cleaning pad in FIGS. 1 through and including 11.

DESCRIPTION—FIGS. 1 AND 6

Figures 1A, 1B:
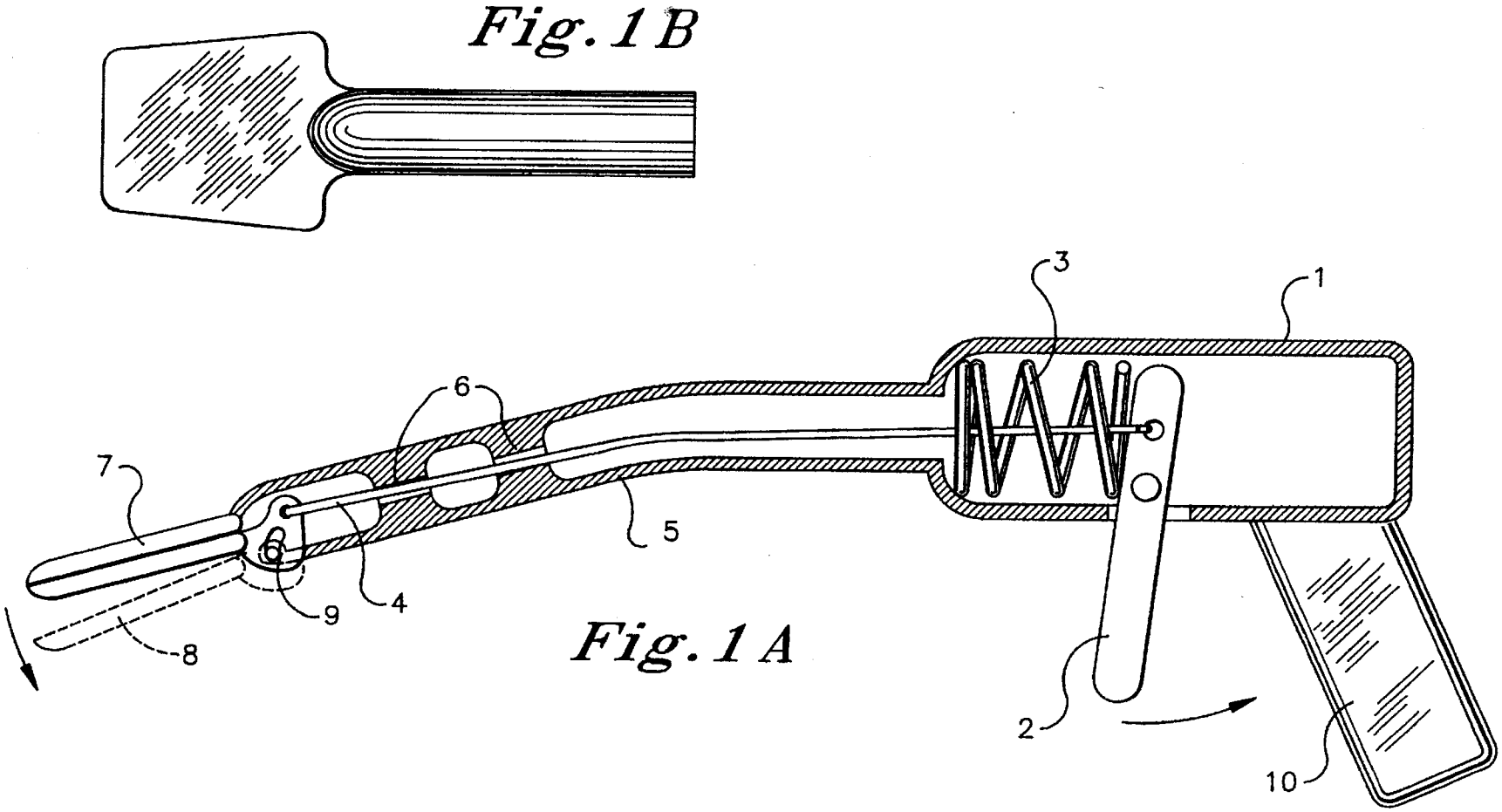
FIG. 1 is an isometric drawing of the side view of the cleaning tool.
Figure 2:
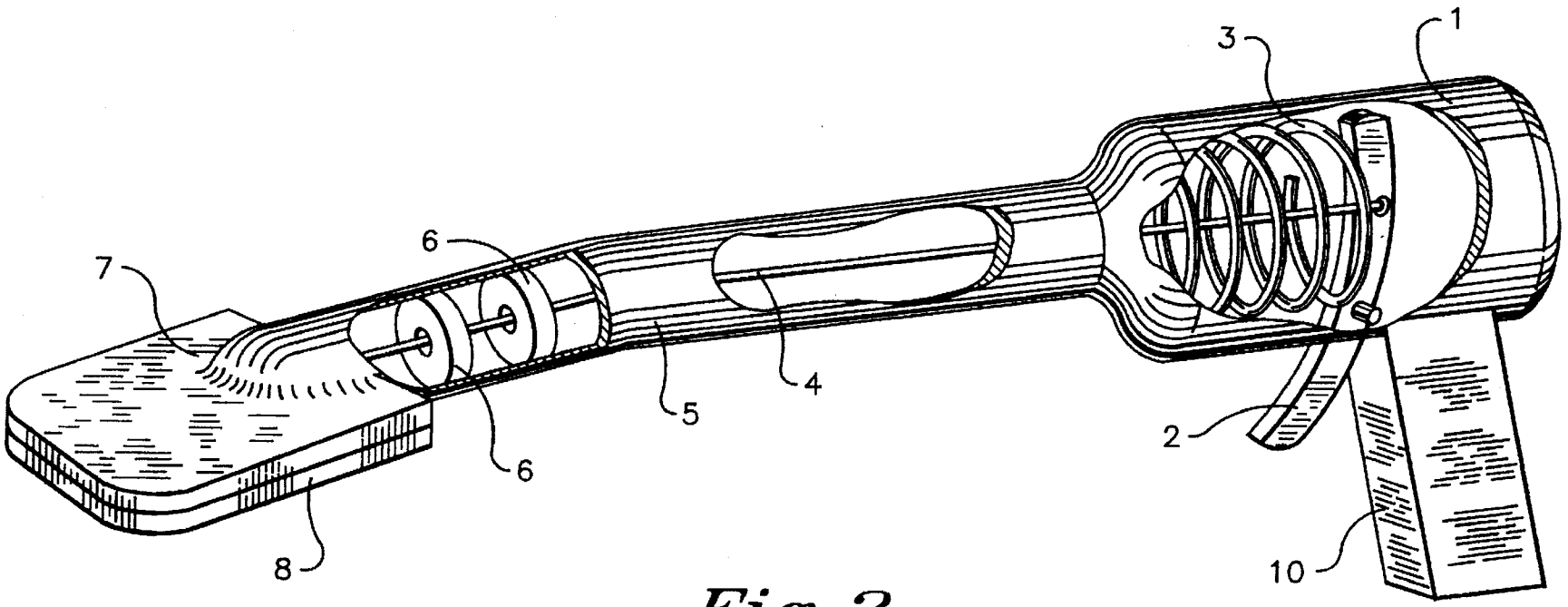
FIG. 2 is partially skeletonized, orthographic view of the cleaning tool showing key elements of the device.
Figure 3:
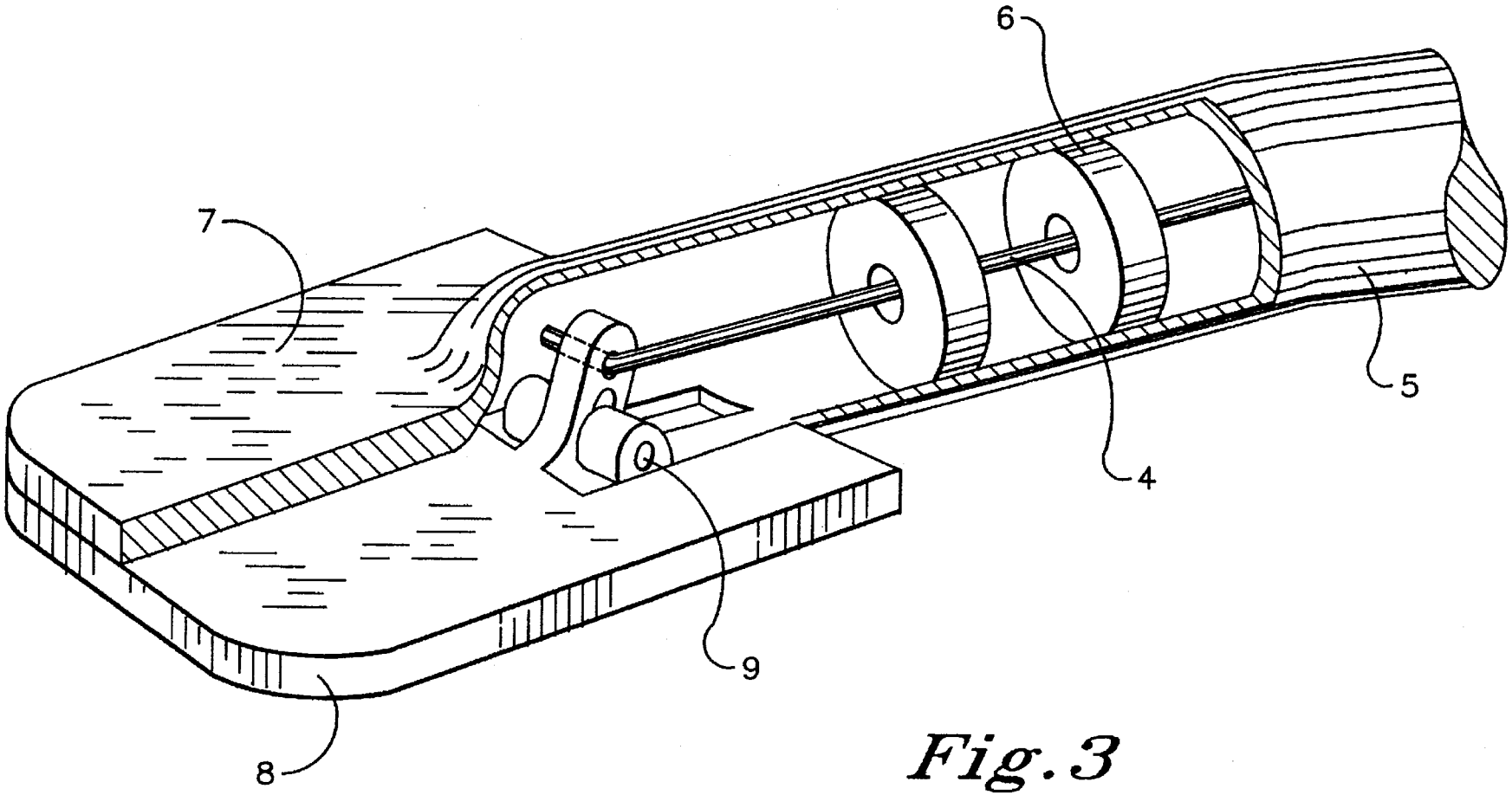
FIG. 3 is a detailed orthographic sketch, partially cutaway, of the jaw operating mechanism.
Figure 4:
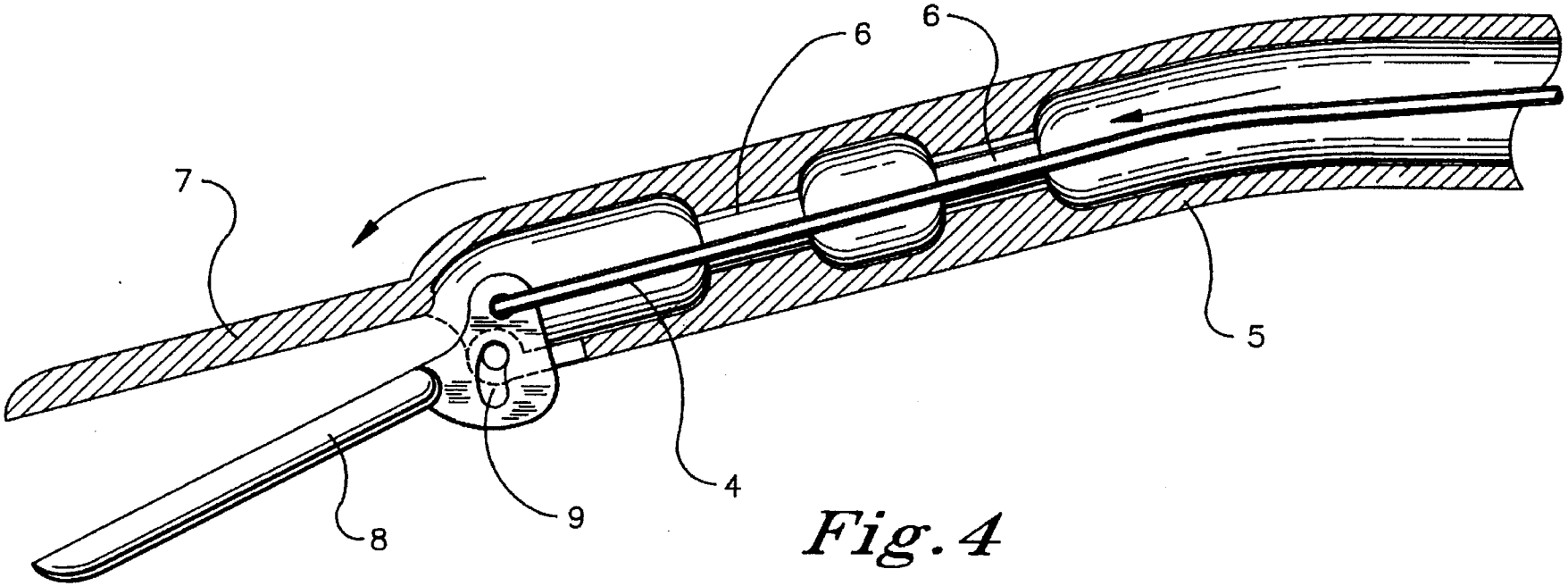
FIG. 4 is an isometric drawing cutaway to show jaw operating mechanism, including "joggle" cam-hinge, in the OPEN position.
Figure 5:
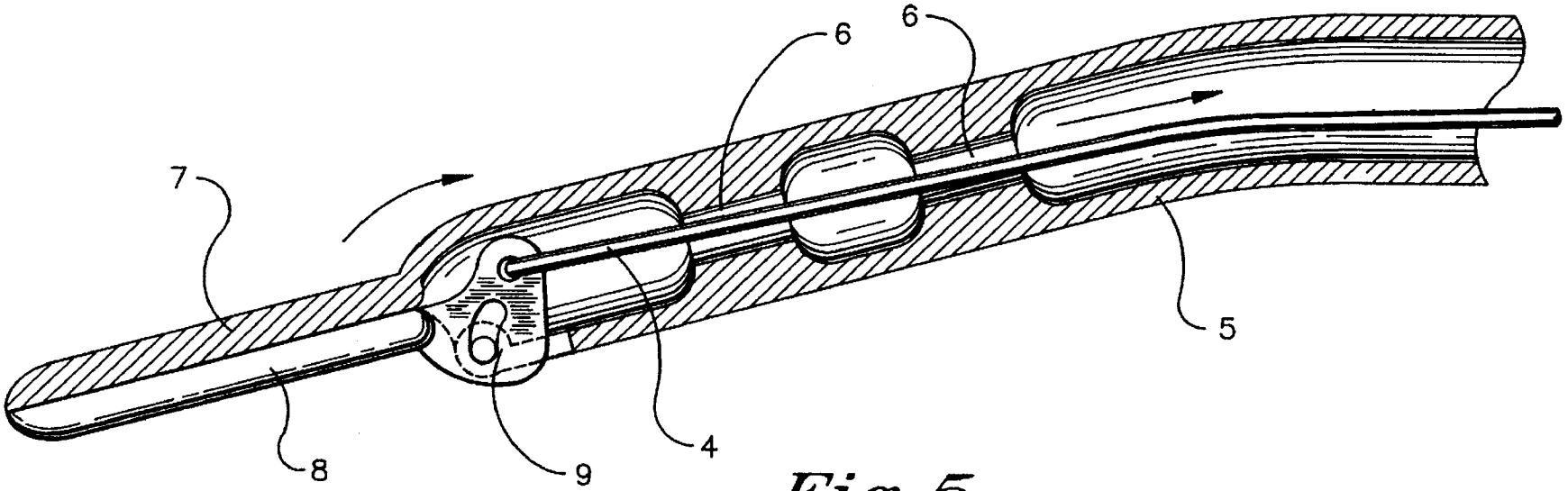
FIG. 5 is a similar drawing showing the jaws in the CLOSED position.
Figure 6A:
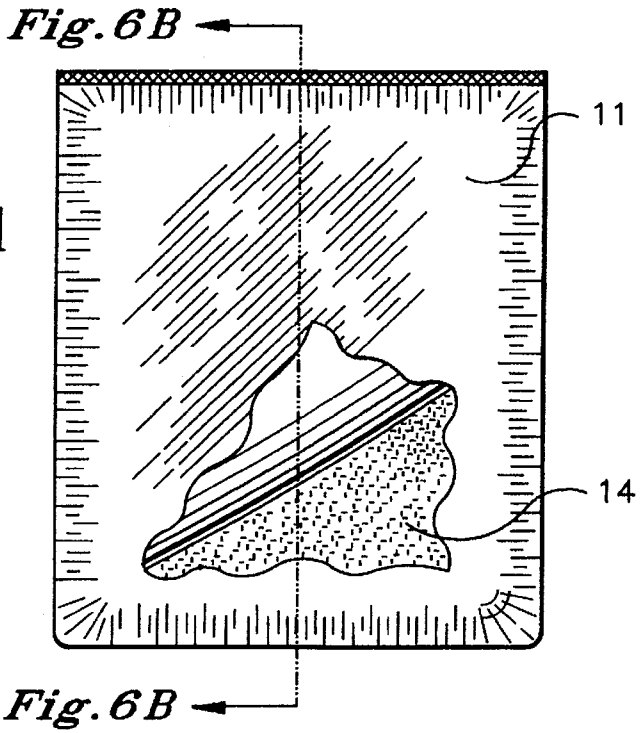
FIG. 6 is an isometric drawing of the cleaning pad.
Figure 6D:
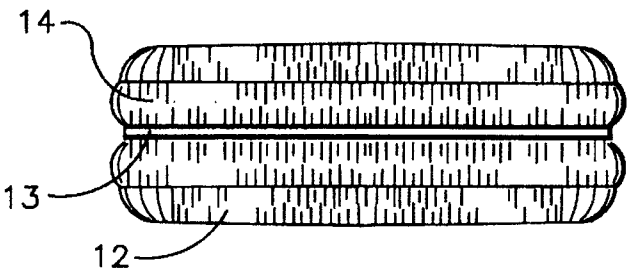
Figure 6B:
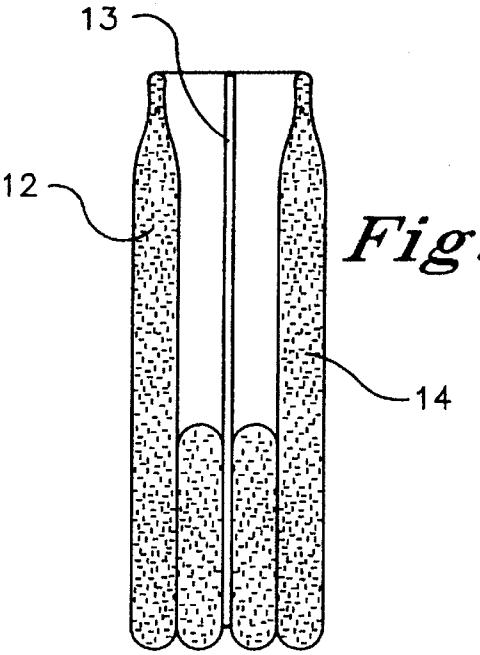
Figure 6C:
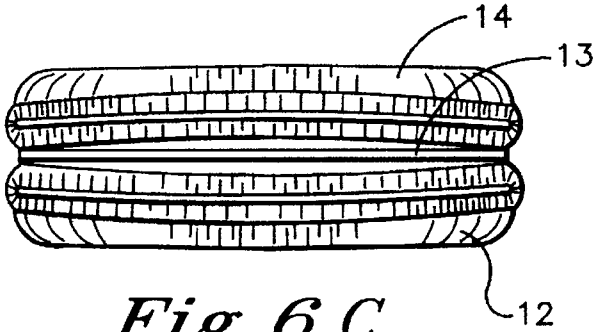
Figure 7:
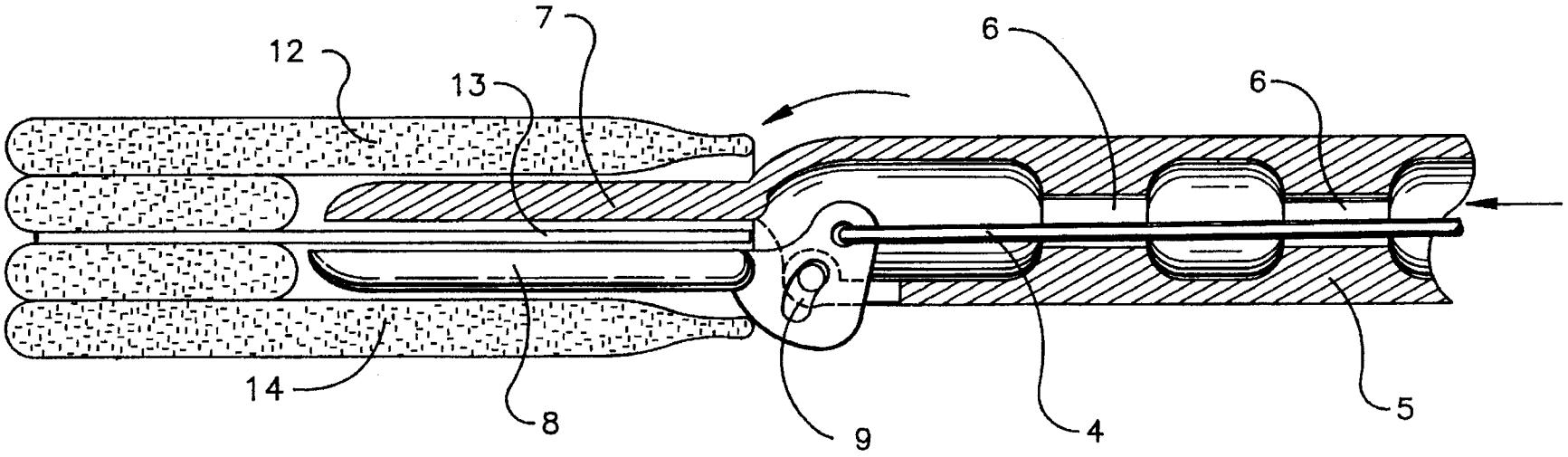
FIG. 7 is an isometric cutaway showing jaws OPEN and inserted into cleaning pad.
Figure 8:
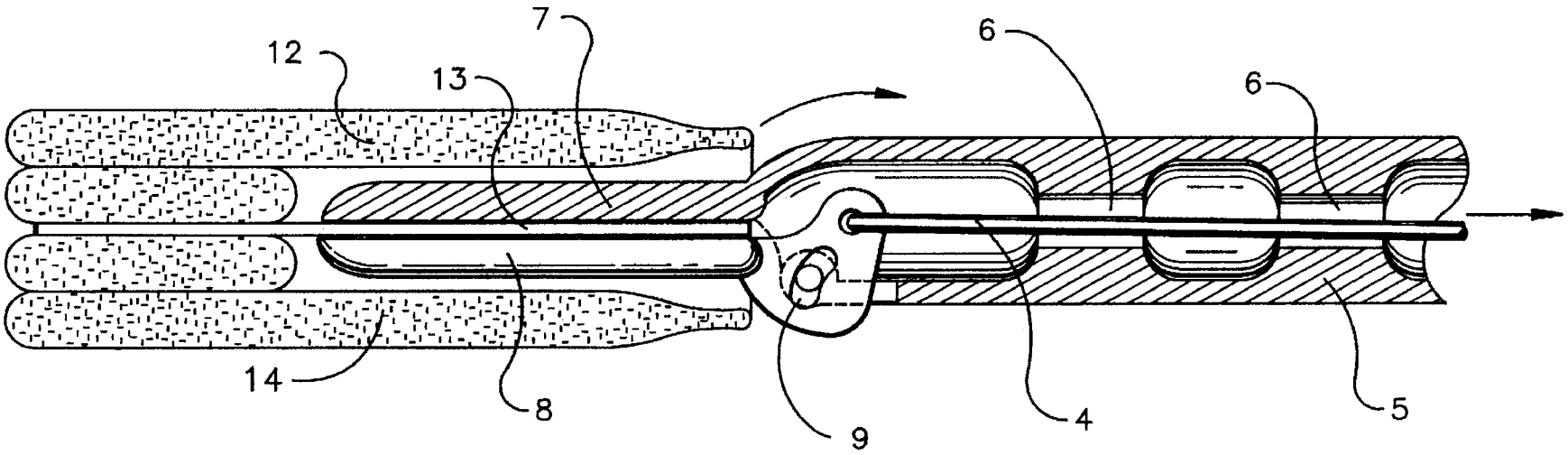
FIG. 8 is another isometric cutaway showing jaws CLOSED with cleaning pad in its grip.
Figure 9:
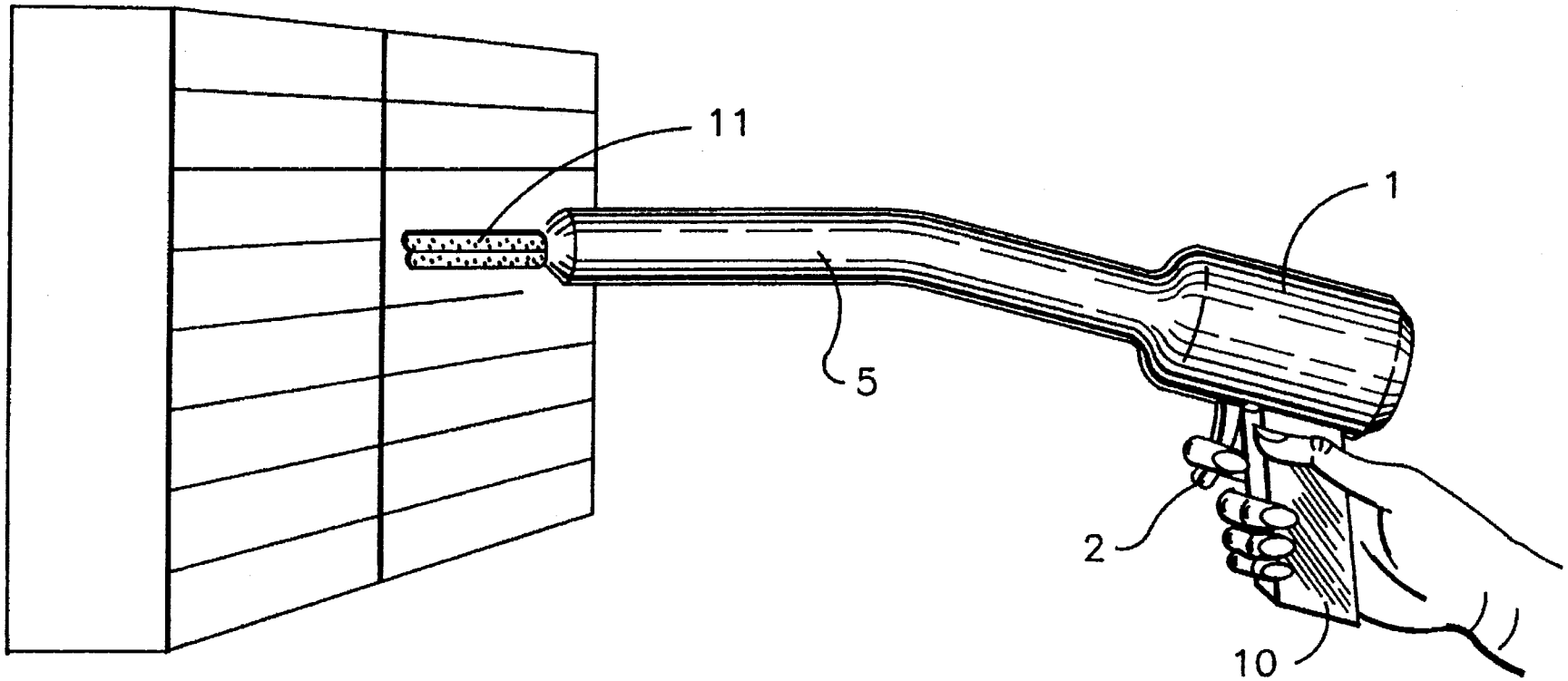
FIG. 9 is a sketch showing how cleaning pad is grasped and removed from storage cabinet prior to use.
Figure 10:
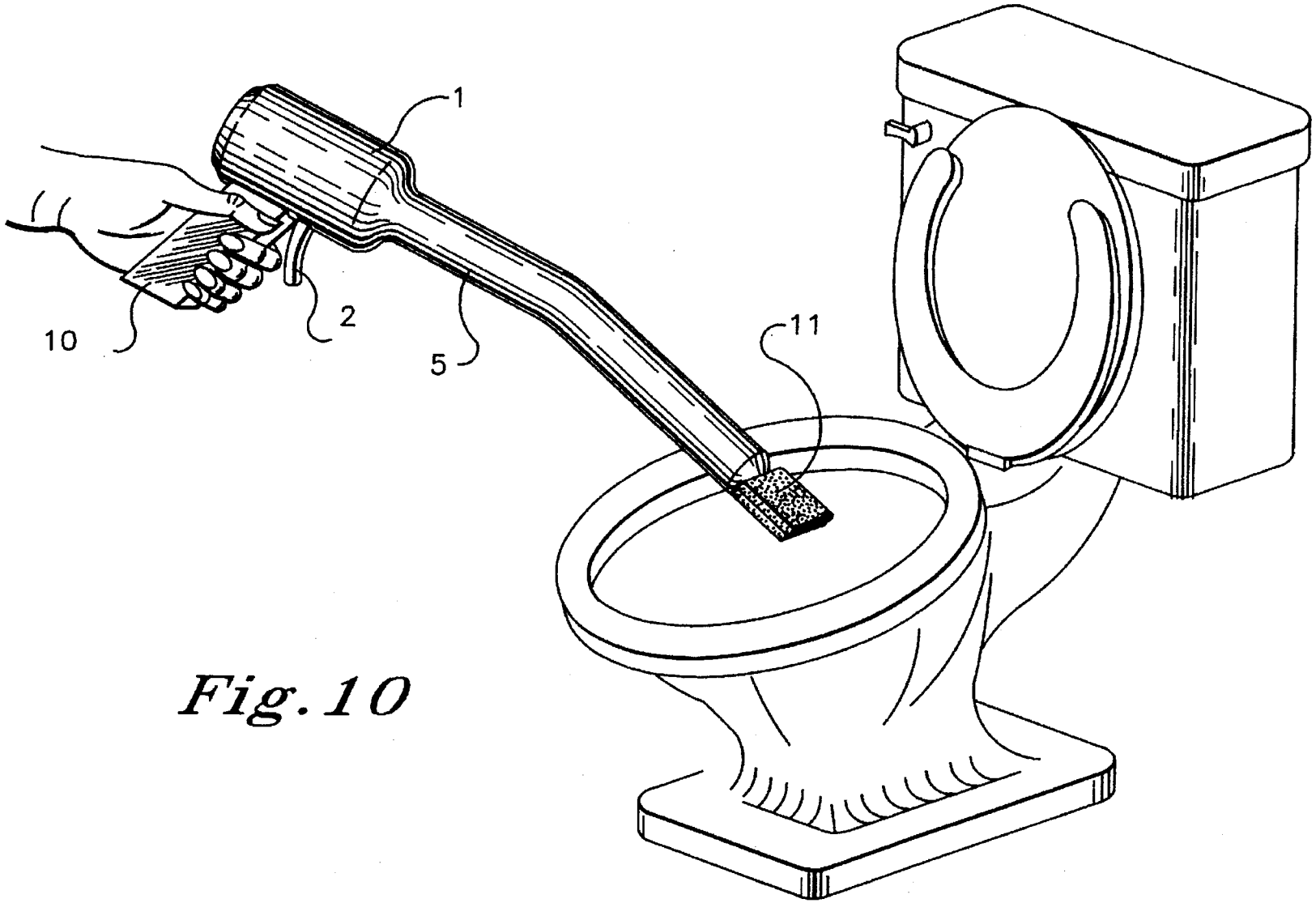
FIG. 10 is a sketch showing the employment of the toilet tool with cleaning pad in a toilet bowl.

A typical embodiment of the present invention is shown in FIG. 1 as a side view. The toilet cleaning tool consists of a receiver unit with handle attached or formed with the unit, 1; a trigger, 2, which compresses or releases the compression of a metal spring, 3; through which travels a piano wire actuating rod, 4, which, along with the spring, acts to position the trigger. The barrel, 5, of the tool is attached to or formed with the receiver unit, and features a nominal 15-degree downward angle from the horizontal. Toward the forward, or jaw-end of the barrel, two spacers, 6, are either formed or emplaced to provide a guide path for the actuator rod to prevent the actuator rod from bending or "trombon-ing" at the forward end. The barrel forward end tapers to form a fixed jaw (top jaw) of the tool, 7, which is a slightly tapered rectangle in form when seen from a top view. The lower jaw is of the same shape and moveable, 8. Its travel is governed by a "joggle" cam hinge, 9, which is attached to the forward end of the piano wire actuating rod. Typically the entire tool (with a few exceptions) should be formed or assembled from a smooth plastic that is impervious to the acids normally found in human waste. Only the circular spring 3 and the piano wire actuator rod 4 need to be made of metal.

The cleaning pad, FIG. 6, is made of a biodegradeable paper. It is a double-wall, double-envelope, 12, anchored in its center by a heavier biodegradable paper "tongue," 13. Within the walls of the cleaning pad is a dry mix of detergent, to which dry disinfectants, and/or deodorants can be added, 14. All of these dry chemicals would be activated by the water of the toilet bowl and transform the pad into a highly effective cleaning medium.

Operations—FIGS. 1 through 10

The manner of using the cleaning tool is simple and straight forward. The operator grasps the handle, 10, and depresses the trigger, 2, which compresses the circular spring, 3, allowing the actuator wire, 4, to move forward while being guided by the two wire guide spacers, 6. The forward moving actuator wire moves the lower grasper jaw, 8, via a cam-slotted, "joggle" hinge, 9. The joggle hinge allows the lower grasper jaw to move down slightly as well as open. This ensures that the "tongue," of the cleaning pad has a clear, unimpeded path when the operator inserts the grasper jaws all the way into the biodegradeable cleaning pad.

When the operator releases the trigger, the circular spring expands moving the actuator wire back toward the handle which in turn closes and locks the lower grasper jaw, over the cleaning pad tongue. The grasper jaws firmly clamps down on the tongue of the cleaning pad. The force to do so is provided by the circular spring's expansion and return to normal size. The operator then moistens the pad in the toilet, FIG. 10, to activate the cleaning and/or disinfectant and/or deodorant powders in the pad, and then proceeds to scrub the toilet with the cleaning pad. The nominal 15-degree offset of the tool handle, 5, and the detergent filled extension of the cleaning pad, 12, serve to allow the cleaning pad to reach under toilet rims as well as to conform to curved surfaces within toilet bowls, urinals, and bidets to allow maximum contact with the surface of the object to be cleaned, FIG. 10.

At the conclusion of the cleaning of the toilet facility, the operator merely holds the end of the toilet tool pointed downward over the center of the toilet and pulls the trigger, 2. This again compresses the coil spring, 3, advances the actuator wire, 4, which opens the lower grasper jaw, 8, and allows the used and wet cleaning pad, aided by the force of gravity, to slide off the grasper jaws and drop into the toilet to be flushed away.

SUMMARY, RAMIFICATIONS, AND SCOPE

Accordingly the reader can see that this invention provides a number of advantages over existing toilet cleaning devices in that

- it permits the user to clean, disinfect, and deodorize toilet facilities thoroughly without the necessity of storing a soiled and germ-laden (and sometimes foul-smelling) cleaning tool between cleaning operations.
- it permits the user to use the tool without having the necessity of touching the cleaning end.
- it permits the user not to have to clean the cleaning end of the toilet cleaning tool since the tool is in essence self-cleaning through its immersion in a detergent and/or disinfectant medium activated by the water in which it is immersed.
- it permits the user to use specially customized cleaning and/or disinfectant and/or deodorant mixtures in the cleaning pad, which is itself composed of biodegradeable materials.
- it permits the user to thoroughly contact all surfaces of the toilet facility due to its design: the nominal 15-degree offset of the tool barrel plus the flexible tip of the cleaning pad, which also contains cleaning powders.
- it permits the user to acquire the cleaning pad in an easy, straightforward manner by merely inserting the tool into the double-enveloped cleaning pad after opening the jaws of the tool slightly.
- it permits the user to easily drop the soiled and used cleaning pad into the toilet and flush it way in a sanitary manner.
- it permits users with limited hand, wrist, and arm motion (due to illness or injury) to clean toilet facilities in an easy and efficient manner.

Although the description above contains many specificities, these should not be construed as limiting the scope of the invention but as merely providing illustrations of some of the preferred embodiments of this invention. For example, the toilet cleaning tool could be made entirely of acid-proofed metal; and, the barrel and receiver composed of various geometrical shapes, and be constructed of a number of different types of plastic. The joggle hinge could be replaced by a less efficient trapdoor hinge, etc.

Thus the scope of the invention should be determined by the appended claims and their legal equivalents, rather than by the examples given.

We claim:

1. A combination toilet cleaning tool and pad comprising:

a toilet cleaning tool having a handle, a movable grasper jaw, a trigger means for moving said jaw and;

a biodegradable cleaning pad having a first envelope and a second envelope, said first and second envelopes containing a water activated detergent and deodorant for cleaning and disinfecting a surface;

said biodegradable cleaning pad further having a biodegradable tongue disposed between said first and second envelopes, wherein during use, said grasper jaw grasps said biodegradable tongue to allow for manipulation of said biodegradable cleaning pad without a user coming into contact with said surface.

2. The toilet cleaning tool and pad according to claim 1, further comprising:

a hollow plastic shaft connected to said handle and housing a spring loaded actuator rod, said actuator rod connecting said trigger means and said grasper jaw.

3. The toilet cleaning tool and pad according to claim 2, wherein said shaft is composed of a first half and a second half;

said second half being offset 15 degrees from said first half, so as to allow the toilet cleaning tool and pad to easily clean underneath toilet rims.

4. The toilet cleaning tool and pad according to claim 1, wherein said water activated detergent and deodorant of said first and second envelopes can be customized for different cleaning agents and deodorants.

* * * * *